US005632101A

United States Patent [19]

Oechsle

[11] Patent Number: 5,632,101

[45] Date of Patent: May 27, 1997

[54] ALL TOP-FELTED SINGLE-TIER DRYING SECTION WITH POST DRYING SECTION CURL CONTROL

[75] Inventor: Markus Oechsle, Bartholomae, Germany

[73] Assignee: Voith Sulzer Papiermaschinen GmbH, Germany

[21] Appl. No.: 526,068

[22] Filed: Sep. 8, 1995

Related U.S. Application Data

[63] Continuation-in-part of Ser. No. 344,736, Nov. 23, 1994, Pat. No. 5,557,860.

[51] Int. Cl.[6] ..... F26B 3/00

[52] U.S. Cl. ..... 34/445; 34/117

[58] Field of Search ..... 34/306, 414, 445, 34/453, 454, 117, 118; 162/119, 135, 197, 270, 211

[56] References Cited

U.S. PATENT DOCUMENTS

| | | | |
|---|---|---|---|
| 3,658,642 | 4/1972 | Keyes, IV et al. | 162/197 |
| 4,282,656 | 8/1981 | Schiel | 34/110 |
| 5,311,672 | 5/1994 | Kotitschke et al. | 34/117 |
| 5,416,980 | 5/1995 | Iivespää | 34/117 |
| 5,557,860 | 9/1996 | Kotitschke et al. | 34/455 |

*Primary Examiner*—John M. Sollecito
*Assistant Examiner*—Steve Gravini
*Attorney, Agent, or Firm*—Ostrolenk, Faber, Gerb & Soffen, LLP

[57] ABSTRACT

A drying section for a paper making machine. The drying section includes a plurality of single-tier dryer groups, optionally followed by one or more double-tier groups. To control curl in the final paper product, a moistening device extending over the width of the drying section is provided near the end of the single-tier dryer groups. The moistening device can be divided into various zones to control the profile of the paper. Alternatively, or in addition to the moistening device, a contact-less dryer such as a infrared dryer can be provided after the dryer section, upstream of a calender section of the paper making machine. The moistening device can be provided to moisten the bottom or, optionally, the top side of the paper web. Where a double-tier dryer group is provided, to control curl the upper drying cylinders and the lower cylinders can be provided with different steam pressures to control curl. Alternatively, each of the cylinders can be individually controlled. In accordance with a further embodiment, control of web curl is not accomplished in the main dryer section, but rather in an after dryer section which follows a device such as a coater, size press or the like which rewets the paper web.

13 Claims, 8 Drawing Sheets

41
40
30
9
S
17
VIII
51
31
16
51B
51A
31a
31b

ALL TOP-FELTED SINGLE-TIER DRYING SECTION WITH POST DRYING SECTION CURL CONTROL

This is a continuation-in-part application of U.S. patent application Ser. No. 08/344,736, filed Nov. 23, 1994 U.S. Pat. No. 5,557,860.

BACKGROUND OF THE INVENTION

The present invention relates to a drying section for drying a traveling fiber web, particularly a paper web. The drying section is preferably part of a paper manufacturing machine. Various drying sections of this type are known, for example, from U.S. Pat. No. 5,311,672 and from Federal Republic of Germany Patent Publication No. 43 28 554 A1.

From these publications it is known to divide a drying section into several successive drying groups. Any one of the drying groups can be developed either as a single-felt drying group or as a two-felt drying group. In one known variant, all drying groups are developed as single-felt drying groups, for instance in the manner that all cylinders have the felt on their top so that the bottom side of the web always comes into contact with the cylinders.

The foregoing arrangement affords the following advantages: The web to be dried is supported and guided continuously by a support belt ("drying wire" or "felt"), at least within each individual drying group. Unsupported lengths of web are thus avoided so that even with extremely high paper web speeds (on the order of up to 2000 meters/min), fluttering of the web is avoided and the danger of the web tearing is considerably reduced. At the transfer zones between adjacent drying groups, there is the option of either avoiding an unsupported (open draw) section of web or of providing a short unsupported length of web. If, in rare cases, the web should nevertheless tear, the torn web pieces (broke) can be easily removed by the force of gravity, due to the fact that all cylinders are top felted.

For the manufacture of certain types of paper it is disadvantageous to dry the paper web solely from one side. The two sides of the finished web may have slightly different characteristics. This results in a tendency to curl, i.e. the edges of the finished web or the edges of sheets of paper (produced from the web) do not lie flat, but bend downward or upward. The paper generally curls towards the side which was dried indirectly, i.e. the side which was in contact with the felt rather then the dryers.

So-called mixed or composite drying sections are also known in which at least one two-felted drying group is provided downstream of several single-felted drying groups. The final drying of the paper web generally takes place in the two-felt drying group, the two sides of the web alternately contacting the drying cylinders. With this arrangement, for numerous types of paper, the tendency to curl is substantially reduced or even completely eliminated. From several United States patents it is known, in the case of such a two-felt drying group serving for the final drying, to control the supply of thermal energy to an upper row of cylinders independently of the supply of thermal steam energy to the lower cylinders. In this way, the tendency of the final paper to curl is also prevented or reduced.

The known measures described above may be sufficient for the manufacture of numerous types of paper. In many cases, however, it is desired to counteract the tendency of the final paper to curl with even greater certainty.

SUMMARY OF THE INVENTION

It is an object of the present invention to meet the aforementioned objectives.

Another object of the invention is to provide a drying section which intentionally imparts to the final web a certain tendency to curl towards a given side. This may be necessary when the two sides of the paper are moistened to a different extent during printing on the final paper product, i.e. during the final use of the paper.

The following considerations and discoveries have led to the present invention: In a dryer section having single-felt drying groups (particularly if all single-felt drying groups have the felt on top), the side of the paper coming into contact with the cylinders is heated more vigorously and therefore dries more rapidly. Therefore, this side of the paper (generally the bottom side of the web) also tends to shrink sooner than the opposite side (as a rule the top side of the web). As a result, a compressive stress is produced in the side of the paper which is dried later in time while a tensile stress develops in the side of the paper which has already dried more strongly. This effect becomes stronger and stronger during the course of the drying process until the one side (as a rule the bottom side of the web) is completely dry. At times, a tendency to curl resulting from this effect can be noted already in this state.

However, toward the end of the drying process, generally the side of the web which was initially dried with delay becomes also completely dry. It can then be noted, in many cases, that the tensile and compressive stresses on the two sides of the paper are reversed so that now there is a tendency of the finished paper to curl in the other direction.

One important idea of the invention is that the side of the paper which dries faster and earlier is intentionally wetted during the drying process. In this way, it is possible to prevent the development of different, opposing tensile and compressive stresses on the two sides of the paper.

In accordance with a first aspect of the invention, a moistening device which is able to supply moisture to the web is provided in a region at the end zone of the drying section. This device can be a water spray device, a steam blow box or similar device. The moistening device may extend over the entire width of the web or over a portion of the web e.g. the edges. It can be subdivided over the width of the web into individually controllable zones, each of which can serve different purposes.

For example, the device serves to correct the transverse profile of the dry solid content of the web and/or to correct a varying or different tendency to curl over the width of the machine. It can happen that there is a greater tendency to curl at the edges of the web than in the middle of the paper web. This results from a difference in the amount of transverse shrinkage. In this case, therefore, the edges of the web will be moistened more intensively than the center of the web. Then it may be sufficient to provide only small moistening devices at the edges of the web rather than one which extends over the entire width of the web.

In accordance with another aspect of the invention, at least one additional contact-less dryer, for instance an infrared dryer, is arranged behind, that is downstream of the single-felt drying groups.

The moistening device can be arranged at different places along the paper making machine. A preferred place is adjacent one of the guide rolls of a single-felt drying groups, e.g. located within the last third of the drying section, as viewed alongside the entire drying section. Another possible location is between the end of the drying section and a following calender. In this case, it is advantageous for at least one of the calender rolls to be a heatable roll. Still another possible location is the space between two successive calenders. Several moistening devices which are preferably distributed over the above-mentioned places can also be provided. Preferably, one or more contact-less dryers will also be arranged between the drying section and the following calender and/or between two calenders.

In all of the aforementioned embodiments of the invention, the drying section can be constructed to consists only of single-felted drying groups. As an alternative, one or more double-felt drying groups can also be provided in the end region of the drying section.

In accordance with a third aspect of the invention, in order to reduce the tendency of the final web to curl, at least one double-felt drying group is provided in the end region of the drying section, in which group the drying rate of at least one of the upper cylinders can be adjusted independently of the drying rate of at least one of the lower cylinders. There are many possibilities for achieving this purpose:

a) Particularly in the initial region of the double-felt dryer group (or of the two-felt drying groups), the feeding of steam energy to at least one of the upper cylinders can be controlled independently of the feeding of steam energy to at least one lower cylinder. Thus, the top side of the web can be brought into contact with more strongly heated cylinders than the bottom side of the web. This measure is particularly effective in the case of many types of paper especially at the beginning of the two-felt (double-felt) drying group or groups in order to reduce the tendency of the finished paper to curl.

b) In drying particularly sensitive types of paper it is, however, advantageous to supply heat energy to each of the cylinders of the two-felt drying group or groups in an individually controllable manner. In this way, the supply of heat energy can be increased or reduced from cylinder to cylinder depending on the individual requirements of the final paper product.

c) Another solution involves establishing different felt tensions on the top and bottom cylinders in the two-felt drying group (or two-felt drying groups). The longitudinal tension in at least one lower felt is preferably set at a higher value, so that the surface pressure between paper web and cylinder surface is increased on the lower cylinders in order to thereby increase the transfer of heat from the lower cylinders to the top side of the web.

d) A further solution involves increasing the drying rate of the lower cylinders of the two-felt drying group by installing, in known manner, condensate disturbance ledges in at least one of the lower cylinders. The construction and action of such disturbing ledges is described in U.S. Pat. No. 4,282,656, the contents of which are incorporated by reference herein.

All the embodiments of the invention which have been described can furthermore also have the feature that most of or all of the guide suction rolls in the single-felt drying group are free of internal stationary suction boxes. In this connection, the vacuum necessary within the perforated suction rolls is preferably produced by means of an external stationary suction box in each case. This measure is preferably combined with a relatively large diameter suction rolls and/or with relatively large spacings between the suction roll and the two adjacent cylinders. In this way, there is obtained a relatively long evaporation path comprising a joint run of the paper web and the felt between the two cylinders (in order to increase the drying rate). Also the arrangement provides a sufficient space and a sufficiently long travel path of the web for the arrangement or effectiveness of the aforementioned moistening device.

Other features and advantages of the present invention will become apparent from the following description of the invention which refers to the accompanying drawings.

BRIEF DESCRIPTION OF THE DRAWINGS

Various embodiments of the invention are shown in the accompanying drawings. Each of FIGS. 1 to 7 is a diagrammatic side view of a drying section of a paper making machine.

DETAILED DESCRIPTION OF THE INVENTION

Figure 1:
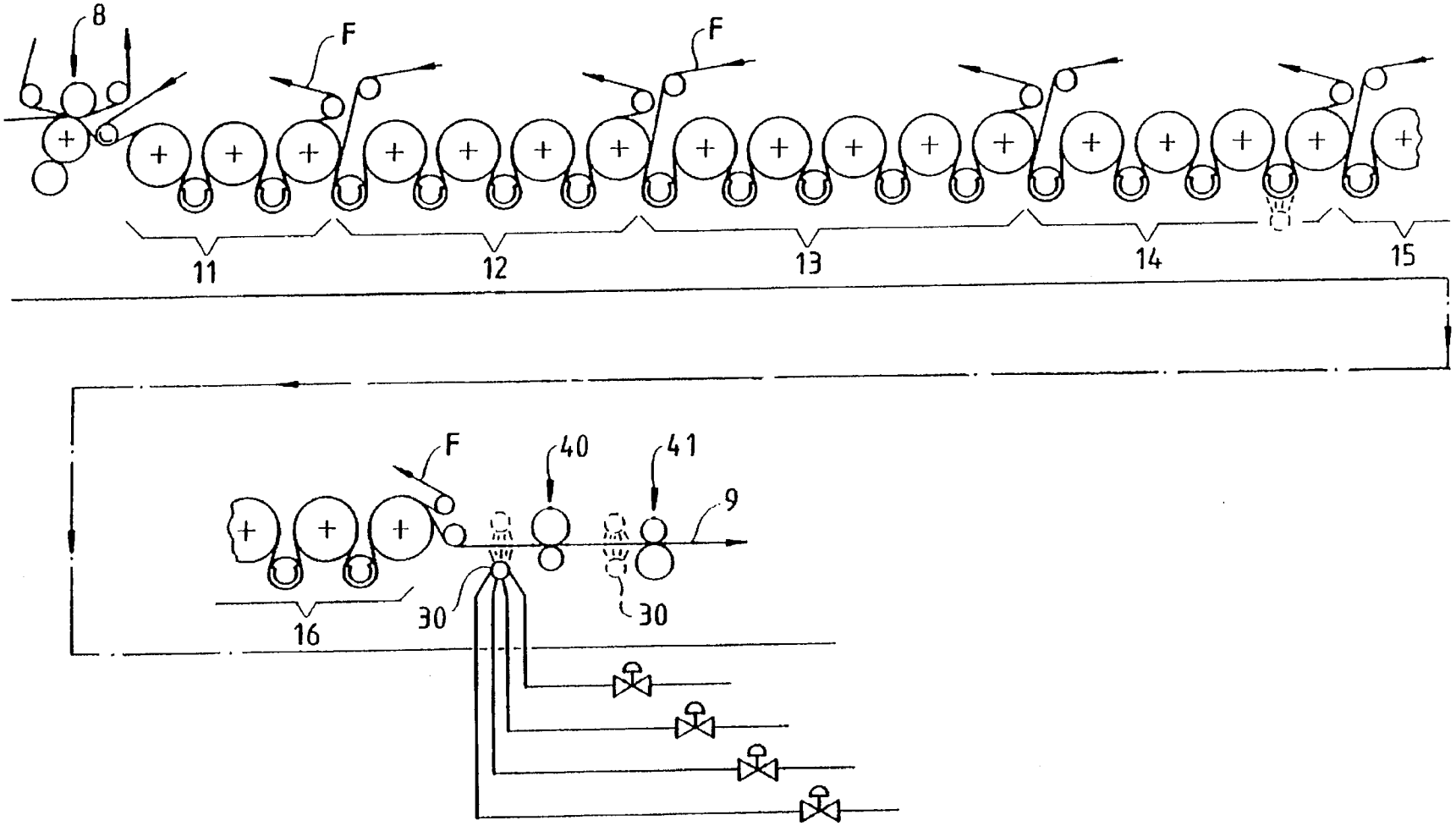
Figure 2:
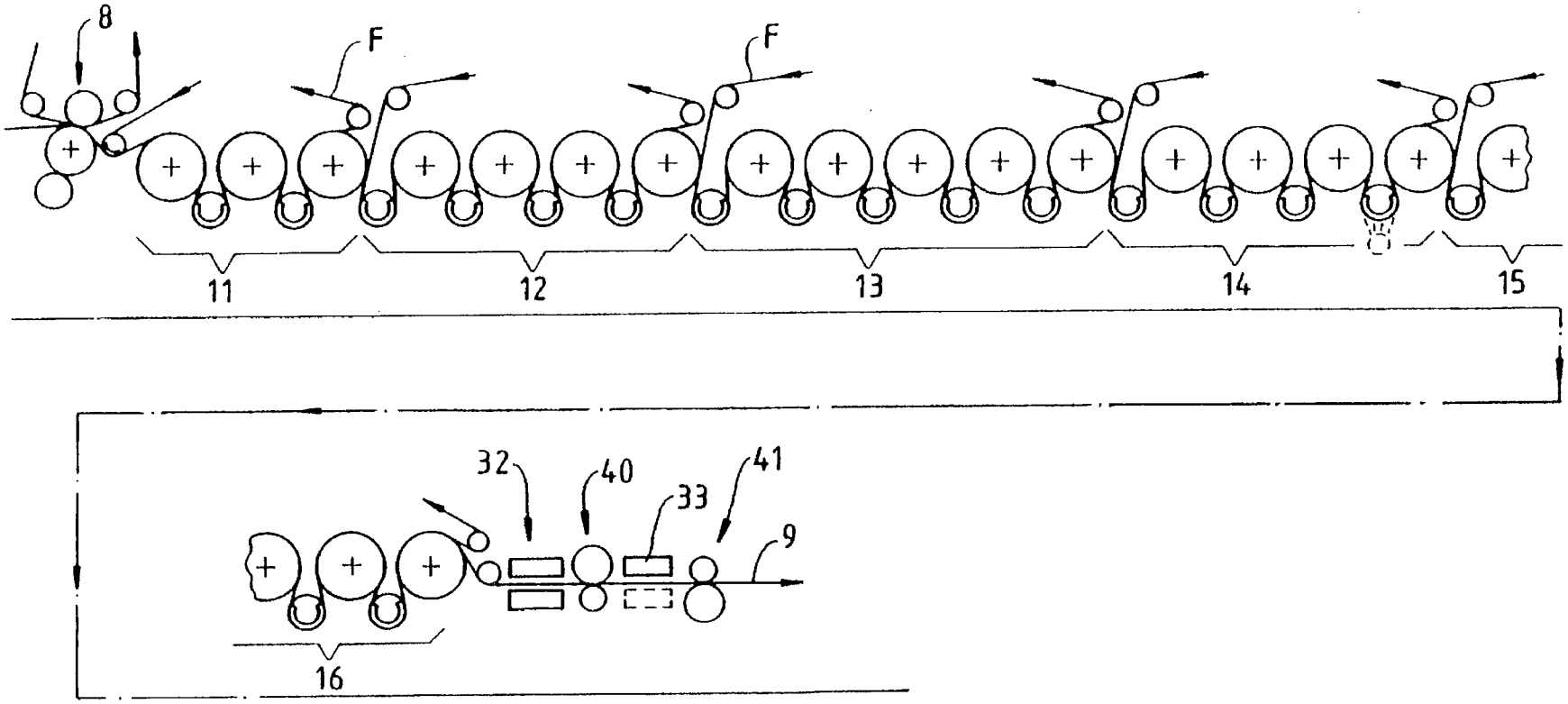

FIGS. 1 and 2 show a drying section consisting exclusively of single-felt drying groups (11–16) with felts F wrapping the tops of the drying cylinders. Also shown is a wet press (8) arranged upstream of the drying section and two calenders (40, 41) arranged downstream of the drying section. In accordance with FIG. 1, moistening devices (30) are provided and in accordance with FIG. 2 additional contact-less dryers, for instance infrared dryers (32, 33), are provided.

The moistening device 30 can have a water feed which can be controlled zone-wise, along the width of the paper web. Furthermore, depending on the production conditions of the paper, moistening devices can also be used for moistening the top side of the paper. This is true, in particular, when calenders (40, 41) are used, where, depending on the direction of tendency to curl, the wetting can be effected either on the top side, in front of the first nip or on the bottom side in front of the second nip, or vice versa.

FIGS. 3 to 7 show mixed drying sections, in which at least one two-felted drying group follows several single-felted drying groups which are top felted.

Figure 3:
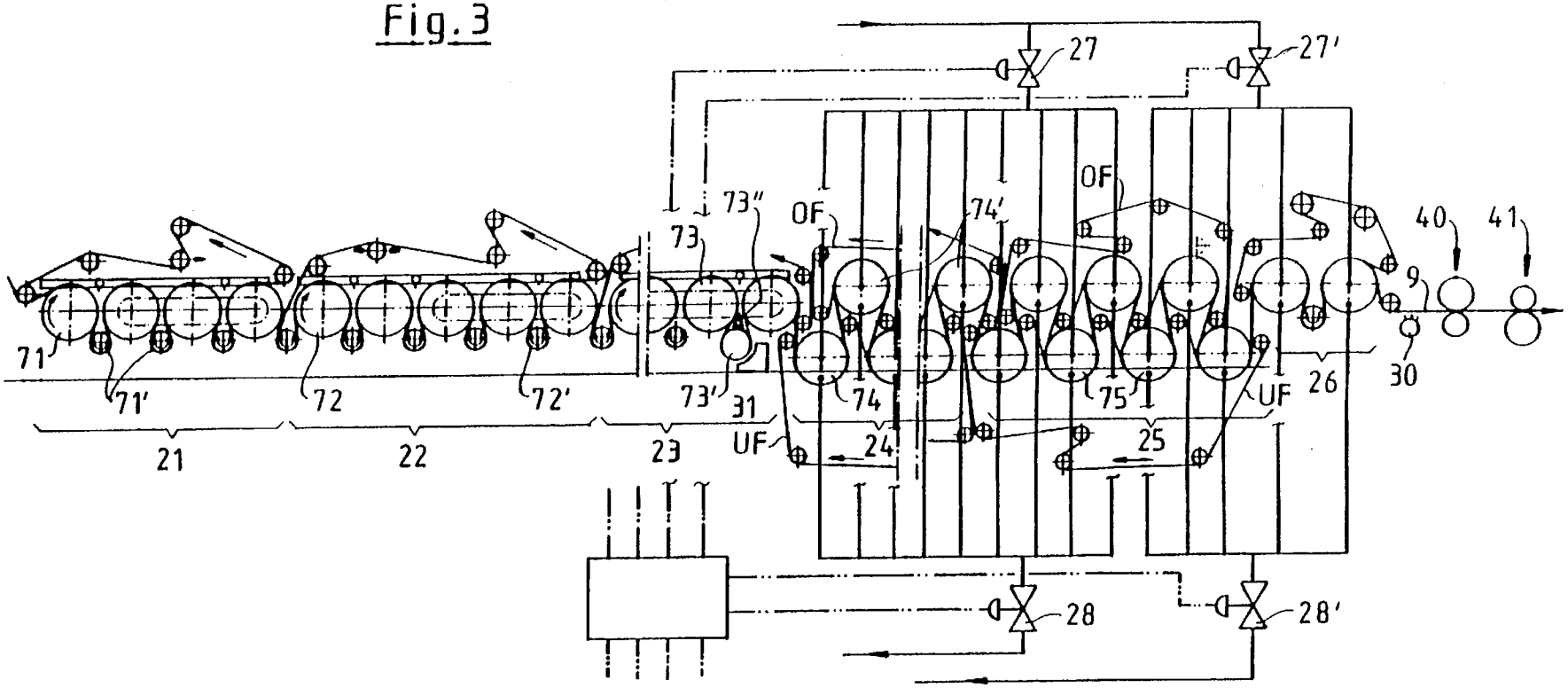

FIG. 3 shows a moistening device (for instance steam blow boxes 31) which are arranged a short distance in front of the transfer from the last single-felt drying group (23) to the following two-felt drying group (24). A further single-felt drying group (26) follows the second two-felt drying group (25). Similar to FIG. 1, a further moistening device 30 may be added between the drying section 21–26 and calenders 40, 41.

In accordance with FIG. 3, the supplying of steam to the upper and lower drying cylinders in the two-felt drying groups is commonly controlled, i.e. by means of a single valve (27, 27') for each heating group (and in the same manner the discharge of the condensate-steam mixture from the cylinders is commonly controlled by means of one common valve 28, 28' for each heating group).

Figure 4:
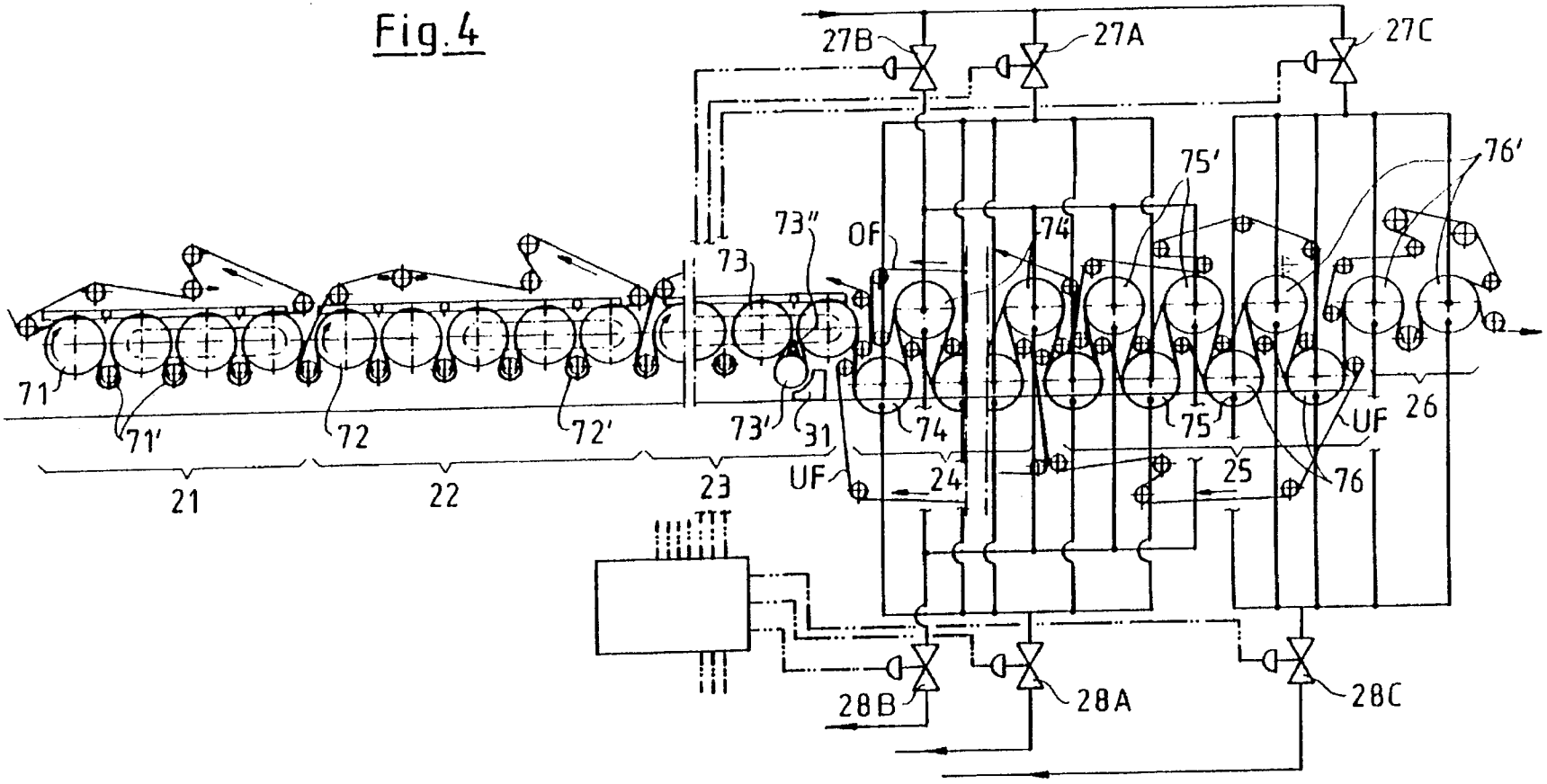

On the other hand, in FIG. 4 in a front upstream region of the two-felt drying groups (24, 25), the feeding of steam to the lower cylinders (74, 75) is controlled (by means of valves 27A and 28A) independently of the feeding of steam to the upper cylinders (74', 75') (by means of valves 27B and 28B). In the rear part of the drying section, on the other hand, steam is uniformly supplied to upper and lower drying cylinders (76' and 76) by means of valves 27C and 28C. In addition, a moistening device (31) can be (if necessary or desired) used.

Both in FIGS. 3 and 4 (see also FIG. 1) the moistening device is positioned to spray water or steam at the paper web, as the paper web traverses one of the transfer guide rolls which are located at the end region of the single tier portion of the paper making machine. An advantage of spraying water or steam at the paper web as it traverses a vacuum roll is that the high suction produced by the vacuum guide rolls serves to draw the moisture deeper into the paper web so that the object to counteract curl can be realized with a lesser amount of water due to the deeper penetration of the water into the paper web. This also affords the possibility of controlling curl by controlling the amount of vacuum supplied inside the vacuum guide roll about which the paper web is being moistened.

Figures 5, 8, 9:
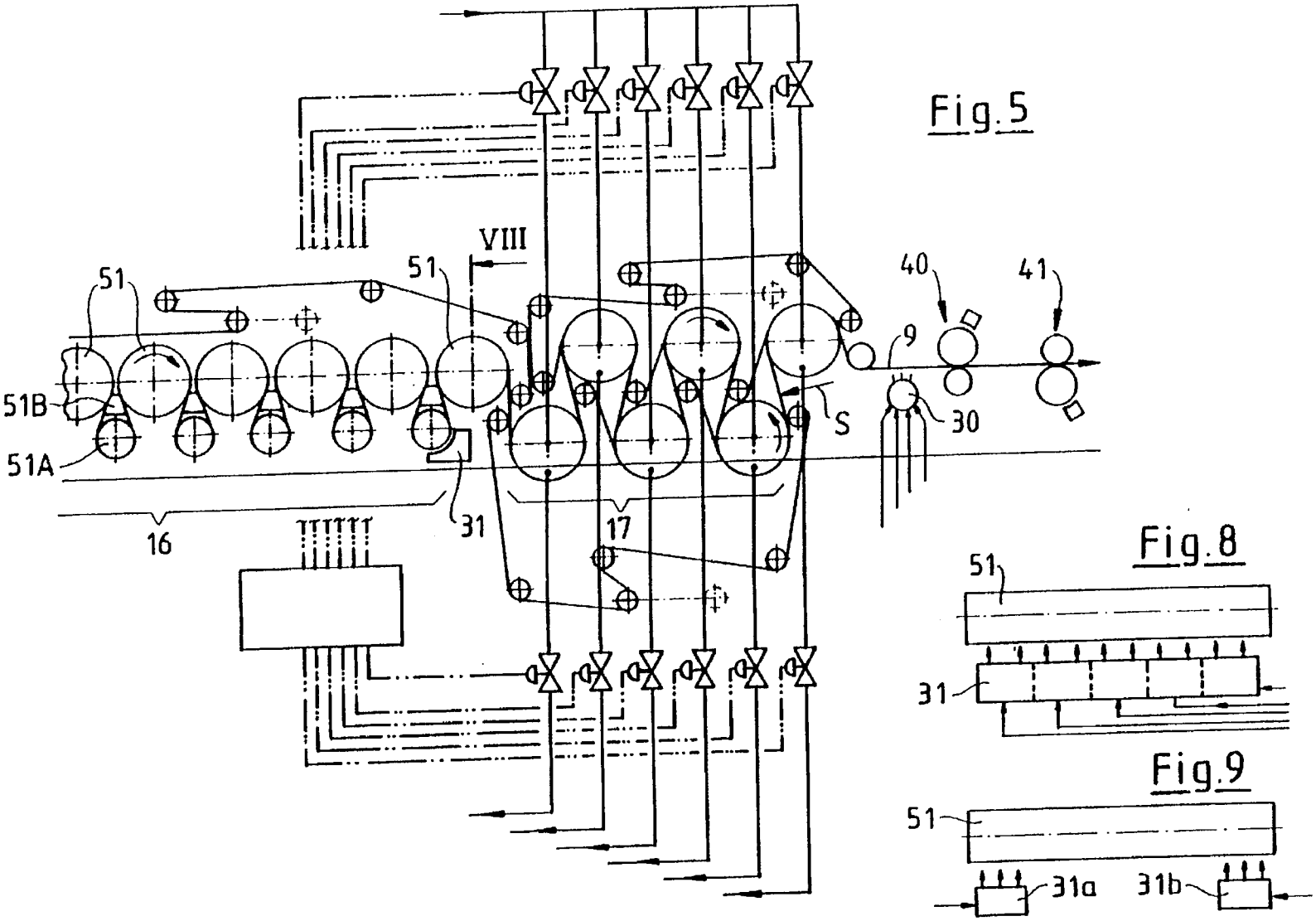
FIGS. 8 and 9 are cross sections along line VIII of FIG. 5.

In accordance with FIG. 5, all guide suction rolls (51A) in the last single-felt drying group (17) are provided with external stationary suction boxes (51B). Such suction rolls (for instance 73', 73") can also be provided in all of the other figures, instead of the suction rolls with inner stationary suction boxes.

As shown in FIG. 5, the feeding of steam to each of the six individual cylinders can be controlled individually in the two-felt drying group (17). As an alternative (not shown), at least one pair of one bottom cylinder and one top cylinder may be added which may be commonly controlled as shown in FIG. 3. Moistening devices 30 and/or 31 may be provided as explained above.

FIG. 8 shows a machine-wide moistening device 31, which may be subdivided into individually controllable zones. FIG. 9 shows an alternative comprising only edge-moistening devices 31*a*, 31*b*.

Figure 6:
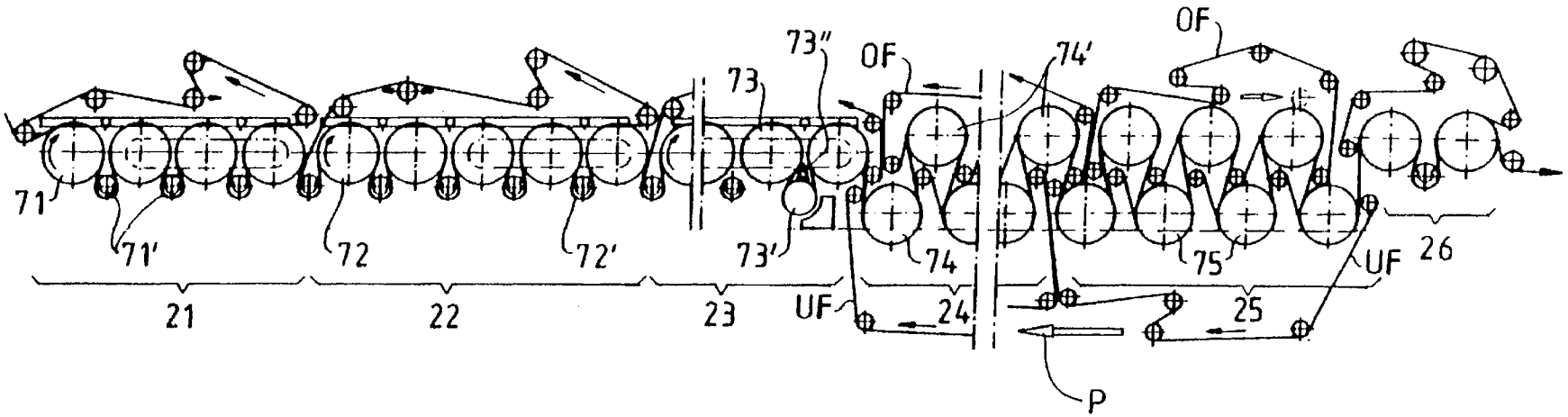

In accordance with FIG. 6, in a two-felt drying group 25 the lengthwise tension of the lower felt UF can be set at a substantially higher value (represented symbolically by the arrow P) than that of the upper felt OF.

Figure 7:
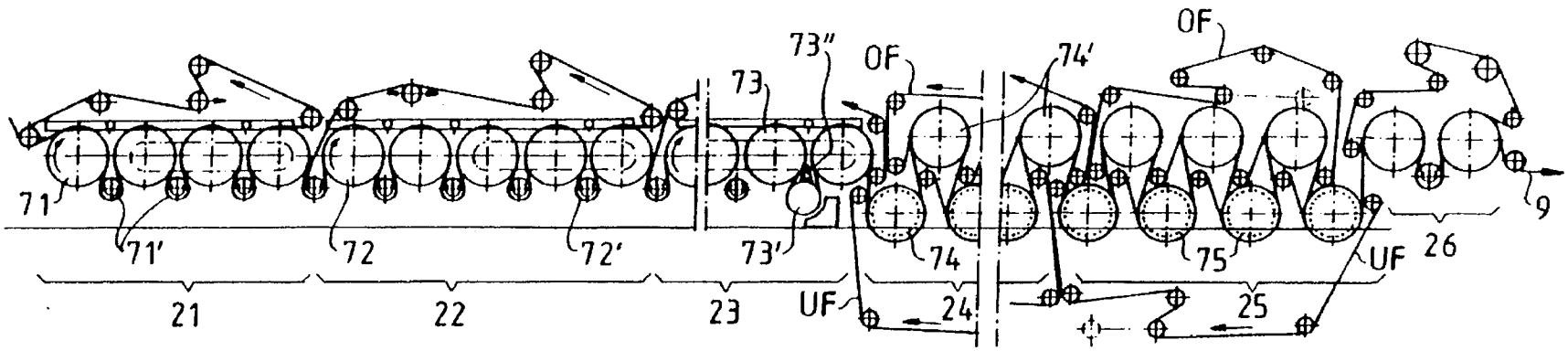

In accordance with FIG. 7, the lower cylinders 74 and 75 of the two-felt drying groups 24 and 25 are provided with condensate-disturbance ledges as represented symbolically by dotted circles.

In FIG. 4, the double-felted dryers are followed by a short single tier dryer group consisting of a pair of dryers 76' and a single vacuum roll.

Figure 10:
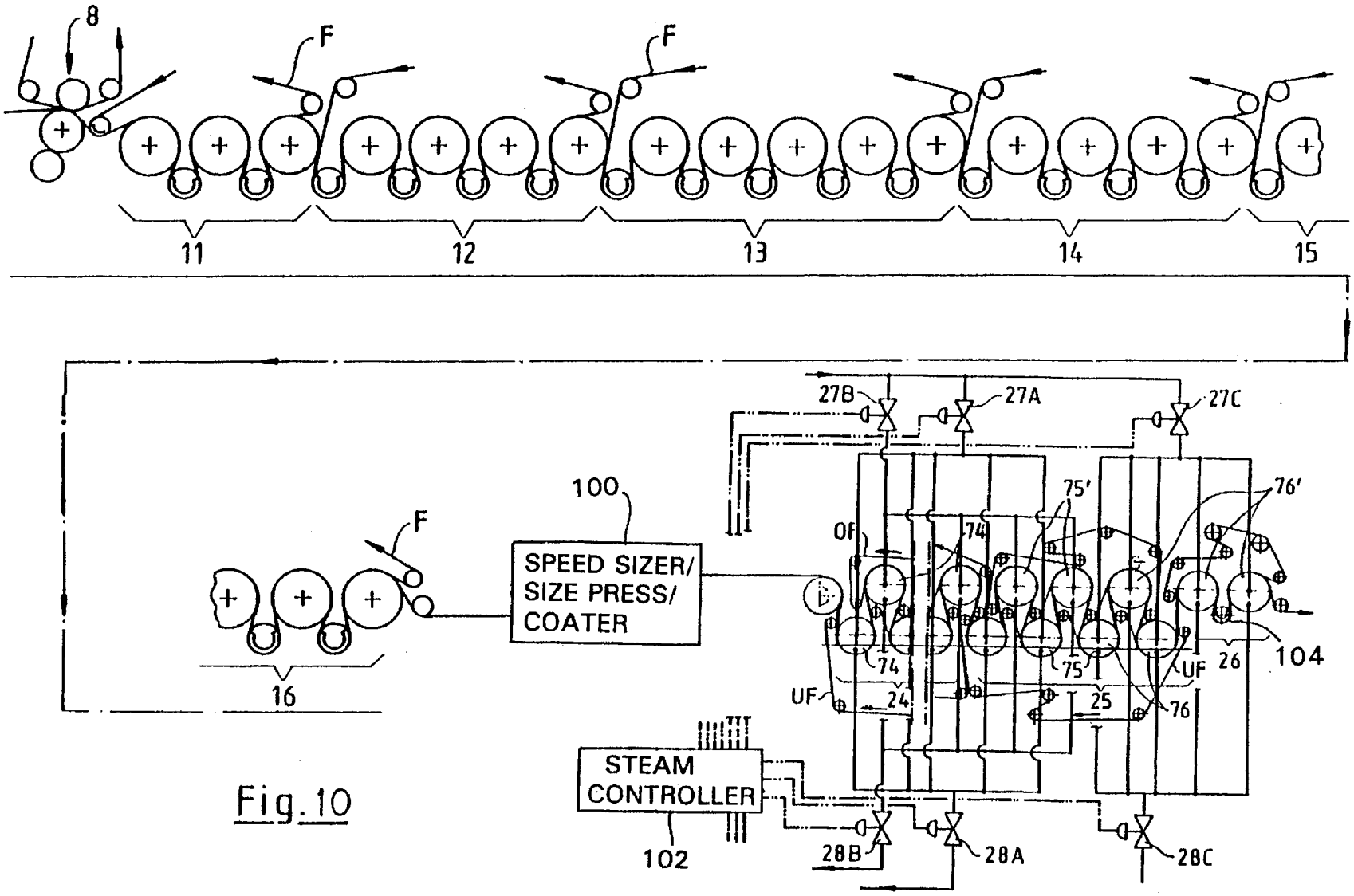
FIG. 10 is a diagrammatic side view of a drying section of an all top-felted drying section in which curl is controlled in an after-dryer section, outside the main drying section.

The embodiment of FIG. 10 differs from the previous embodiments in that no measures are taken to control curl in the main drying section which consists solely of single-tier, top-felted dryer sections 11, 12, 13, 14, 15 (partially drawn) and 16 (partially drawn). In this paper machine, the paper web proceeds from the main, all top-felted, drying section to an intermediate device 100 which is depicted as a black box representing either a Speedsizer® size press, a coater or the like. In any event, the web has applied to it some type of coating at the device 100 to improve its printability and/or other qualities. The paper web proceeds from the device 100 to a so-called after-dryer drying section illustrated here as a double-tier dryer section comprising upper cylinders 74' and 75' and lower dryers comprising dryers 74 and 75.

As previously described, these dryers are supplied with steam and the steam pressures in the top dryers and the bottom dryers are separately controlled via a central steam controller 102. This steam controller 102 controls steam pressure regulating valves such as the valves 28A, 28B, 27A, 27B and 27C, in the well known manner which permits or enables controlling curl.

Although FIG. 10 also illustrates a final, after-dryer dryer section 26 consisting of two dryers 76' and an intermediate vacuum guiding roll 104, such dryer section 26 is not absolutely necessary for the purposes of controlling curl which is accomplished in accordance with the embodiment of FIG. 10 by use of the aforementioned double-tier after dryer drying section.

Recent investigations have surprisingly demonstrated, contrary to conventional wisdom, that for many paper grades it is possible to dry the paper web entirely from one side, so long as such drying is followed by an operation which rewets the paper to a degree, as invariably happens when the device 100 of the present invention is used. Thereafter, curl control is accomplished by means of an otherwise conventional after dryer double-tier dryer section as described above.

Although the after-dryer drying section of FIG. 10 consists of a first double-tier dryer section containing four dryers and a second double-tier dryer section containing seven dryers, one or two or even three such double-tier dryer sections can be used, and each such dryer section can include as many or as few drying cylinders as are necessary to complete the drying of the paper web after it has been coated in the device 100.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method for drying a paper web in a papermaking machine, the method including the steps of:

guiding the paper web through a main drying section including a plurality of heatable dryers for contacting the paper web, in each of a plurality of successively located dryer groups, in which each of the dryer groups is a single-tier, top-felted dryer group, so that the paper web is dried in the main drying section solely from one side thereof;

moistening the paper web by applying to it a coating material;

guiding the paper web through an after-dryer, double-tier dryer section to heat opposite sides thereof; and separately controlling steam pressure in an upper-tier of dryers and in a bottom-tier of dryers associated with the double-tier dryer section to control the steam pressure therein in a manner which tends to reduce a curl parameter associated with the paper web.

2. The method for drying a paper web in accordance with claim 1, further including guiding the paper web through a final, short, dryer section comprising a pair of first and second dryers with one intermediate vacuum suction roll disposed between and below the first and second dryers.

3. The method of claim 1, further including guiding the paper web through the main drying section without open draw.

4. The method of claim 1, further including controlling the longitudinal tension of at least one of a lower felt and an upper felt of the double-tier dryer section to provide different tensions in the lower felt and in the upper felt.

5. The method of claim 1, further including controlling heat generated in the upper-tier dryers and in the bottom-tier dryers by providing in at least one of the bottom-tier and upper-tier dryers condensate-disturbance ledges.

6. A drying apparatus for the drying of a paper web in a paper making machine, the drying apparatus comprising:

a main drying section including a plurality of heatable dryers for contacting the paper web, in each of a plurality of successively located dryer groups, in which each of the dryer groups is a single-tier, top-felted dryer group, so that the paper web is dried in the main drying section solely from one side thereof;

a coating device for applying a wet coating material to the paper web following the emergence of the paper web from the main drying section;

at least one double-tier, after-dryer dryer section following the coating device, the double-tier drying section including upper-tier dryers and bottom-tier dryers; and a curl controlling device including a controller for controlling steam pressure in the upper-tier dryers and in the bottom-tier dryers of the at least one double-tier dryer section for reducing the tendency of the paper web to curl.

7. The drying apparatus of claim 6, in which the at least one after-dryer, double-tier dryer section includes at least two double-tier dryer sections.

8. The drying apparatus of claim 6, further including means for controlling a longitudinal tension of at least one of a lower felt and an upper felt of the at least one two-tier dryer section to provide different tensions in the lower felt and in the upper felt.

9. The drying apparatus of claim 6, in which one of the upper-tier dryers and the bottom-tier dryers of the at least one double-tier dryer section is provided with condensate-disturbance ledges.

10. The drying apparatus of claim 6, in which the plurality of top-felted, single-tier dryer sections comprise intermediate suction guide rolls between the dryers and in which the intermediate suction guide rolls are free of internal stationary suction boxes.

11. The drying apparatus of claim 10, in which a respective external stationary suction box is associated with each of the suction guide rolls that are free of an internal stationary suction box.

12. The drying apparatus of claim 6, in which the coating device is a coater which applies a starch containing coating to the paper web.

13. The drying apparatus of claim 6, in which the coating device is a size press which applies a coating material to the paper web which improves the printability thereof.

* * * * *